United States Patent [19]

Owlett

[11] Patent Number: 4,494,093

[45] Date of Patent: Jan. 15, 1985

[54] LOCKABLE TUNING MECHANISM WITH REDUCED BACKLASH

[75] Inventor: David D. Owlett, Belmont, Calif.

[73] Assignee: GTE Communications Systems Corporation, Phoenix, Ariz.

[21] Appl. No.: 437,935

[22] Filed: Nov. 1, 1982

[51] Int. Cl.[3] ..... H01P 7/04; H01P 7/06; H01P 1/28

[52] U.S. Cl. ..... 333/232; 333/207; 333/222; 333/226

[58] Field of Search ..... 333/202, 206–212, 333/221–235, 245, 248, 263; 74/84 R, 826, 840, 10.33; 334/40, 43

[56] References Cited

U.S. PATENT DOCUMENTS 2,473,310 6/1949 Strutt et al. ..... 333/226

4,041,421 8/1977 Owlett ..... 333/209

*Primary Examiner*—Marvin L. Nussbaum

*Attorney, Agent, or Firm*—Russell A. Cannon

[57] ABSTRACT

Apparatus for frequency tuning a waveguide cavity comprises a retainer ring and a knob that are threaded onto a plunger in a spaced apart relationship, with the plunger extending into the cavity. Means is provided for preventing rotation of the plunger and for securely rotatably mounting the knob on the cavity. Set screws in threaded holes extending through the knob protrude into blind holes in the ring for mechanically coupling them together. Lightly threading the screws into the blind holes reduces backlash in the threads so that rotation of the knob, and thus the ring, causes smooth and even movement of the plunger in the cavity. Tightening the screws firmly in the blind holes binds the threads on the knob, ring and plunger for preventing further rotation of the knob and movement of the plunger.

12 Claims, 3 Drawing Figures

LOCKABLE TUNING MECHANISM WITH REDUCED BACKLASH

BACKGROUND OF THE INVENTION

This invention relates to threaded tuning mechanisms, and more particularly to method and apparatus for reducing backlash in and locking the position of a threaded tuning mechanism in the wall of a waveguide.

A variety of microwave devices such as frequency modulated oscillators (FMO's), amplifiers, multipliers, filters, etc. include a waveguide or other cavity supporting electro-magnetic waves. The cavity may be tuned with a metallic screw, probe or other sliding short circuit type of plunger that extends through a wall thereof. The operating frequency of a FMO, for example, is tuned by means of a threaded knob that is securely-rotatably mounted on the exterior of the enclosure. Rotation of the knob causes axial movement of a sliding short circuit inside the enclosure for changing the length of the resonant cavity and thereby adjusting the resonant frequency. It is desirable that threads in the tuning knob and on the plunger provide smooth and even movement of the plunger in opposite directions so as to provide continuous and even tuning of the device. It has been found that during and after the tuning process the axial position of the sliding short may change abruptly as the direction thereof is reversed in the cavity or from shock and vibration of the device such as occur when it is bumped or moved between work stations. It has also been found that precision fitting class 3 threads, for example, which are expensive and difficult to utilize on a production basis, do not totally compensate for backlash in the tuning mechanism. And as a practical matter, it is not possible to maintain perfectly fitting threads on a production basis. Set screws contacting the threads on the circumference of the plunger have also been used previously to lock the position of a tuning element, but this may damage the threads and produce an offset of the plunger which causes a frequency shift. Also, this does not compensate for backlash in the threads.

An object of this invention is the provision of an approved adjustment and locking mechanism for a pair of threaded elements.

SUMMARY OF INVENTION

In accordance with this invention, the method of precisely locating the axial position of a first member that is threaded into an opening in knob means, the latter being securely-rotatably mounted on a support member so as to prevent axial movement thereof, and of selectively locking the knob means so as to prevent further rotation of the knob means and axial movement of the first member comprises the steps of: threading the first member into an opening in a second member, the latter being located on one side of the knob means; at least a pair of holes extending completely through one of and only part way through the other of the knob means and second member, the holes in the one and other of the knob means and second member being threaded and having a diameter that is greater than the major diameter of the threaded holes, respectively; spacing the knob means and second member a predetermined distance apart on the first member with associated holes therein being aligned; preventing rotation of the first member so that rotation of the knob means causes axial movement of the first member within the knob means and along the axis; threading screw means through each hole in the one of and into the blind hole in the other of the knob means and second member with the end of the screw means either lightly touching or backed away from the bottoms of the blind holes in the other of the knob means and second member; rotating the knob means, and thus the second member, for providing axial movement of the first member to a desired position; and tightening the screw means into the blind holes for causing the ends thereof to firmly contact the bottoms of the blind holes in the other of the knob means and second member for binding the threads on the knob means and first and second members for preventing both further rotation of the knob means and axial movement of the first member. In an alternate method, the screw means are tightened to press the ends thereof lightly against the bottoms of the blind holes for substantially eliminating backlash in threads prior to rotating the knob means.

In accordance with another aspect of this invention, apparatus for precisely locating the axial position of probe means, the probe means being threaded into an opening in a knob means that is securely-rotatably mounted on a wall for preventing axial movement thereof, and for selectively locking the knob means so as to prevent both further rotation of the knob means and axial movement of the probe means comprises: a first member that is threaded onto the probe means on one side of the knob means and spaced a prescribed distance therefrom; said first member and knob means having at least a pair of holes extending completely through one of and only part way through the other of said knob means and first member when associated holes therein are aligned, the holes in the one and other of said knob means and first member being threaded and having a diameter that is greater than the major diameter of the threaded holes, respectively; first means for preventing rotation of the probe means so that rotation of the knob means causes axial movement of the probe means in the knob means; and screw means threaded through each hole in the one of and into the blind hole in the other of the knob means and first member, with ends of the screw means either lightly touching or backed away from the bottoms of the blind holes in the other of the knob means and first member; rotation of the knob means, and thus the first member, providing axial movement of the probe means to a desired position; tightening the screw means into the holes for causing the ends thereof to firmly contact the bottoms of the blind holes in the other of the knob means and first member binding the threads on the probe means and in the knob means and first member for preventing both further rotation of the knob means and axial movement of the probe means.

DESCRIPTION OF DRAWING

This invention will be more fully understood from the following detailed description of preferred embodiments thereof, together with the drawing in which the various figures are not drawn to scale and wherein.

DESCRIPTION OF PREFERRED EMBODIMENTS

Figure 3:
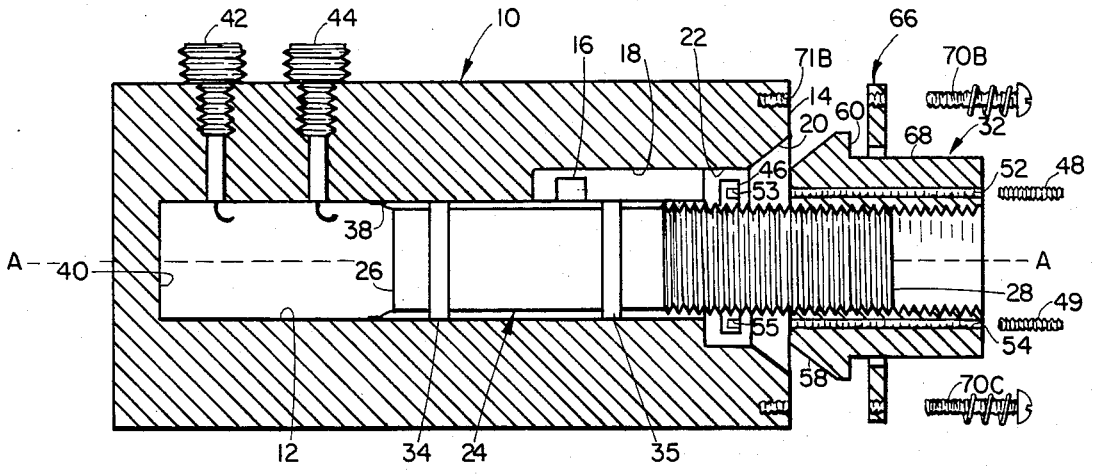
FIG. 3 is an exploded view of a section taken along lines 3—3 in FIGS. 1 and 2.

The tunable waveguide cavity illustrated in the figures may operate as a reference cavity. Referring now to FIG. 3, the tunable cavity there comprises an elongated brass block 10 having a circular bore 12 in the one end 14 thereof, a keyway 18 that opens into the bore, and a counter sunk hole 20 in the one end 14 and which extends into a recess 22 there for defining a smooth tapered surface at 20; a brass plunger 24 having the one end 26 thereof in the bore 12 for defining the length of the cavity, and having its circumference threaded over a length thereof that is adjacent its other end 28; and a brass tuning knob 32 that is threaded onto the plunger and is rotatably secured on the one end 14 of the block for adjusting the axial position of the plunger in the bore and thereby tuning the cavity. The plunger is supported in the center of the bore by a pair of spaced apart dielectric rings 34 and 35 which fit snugly over the circumference of the plunger. A key 16 is pressed into an opening in the circumference of the plunger with the sides of the former being parallel to the axis A—A of the bore. The key 16 is dimensioned to slide smoothly in the keyway 18 for preventing rotation of the plunger in the bore. Alternatively, the key may be a cylindrical peg. Electrically conductive shorting fingers 38 are attached to the circumference of the plunger adjacent the one end 26 thereof for contacting the walls defining the bore 12 and establishing one end of the cavity. The other end of the cavity is the bottom 40 of the bore. Coaxial connectors 42 and 44 couple electromagnetic signals into and out of the cavity.

Figure 1:
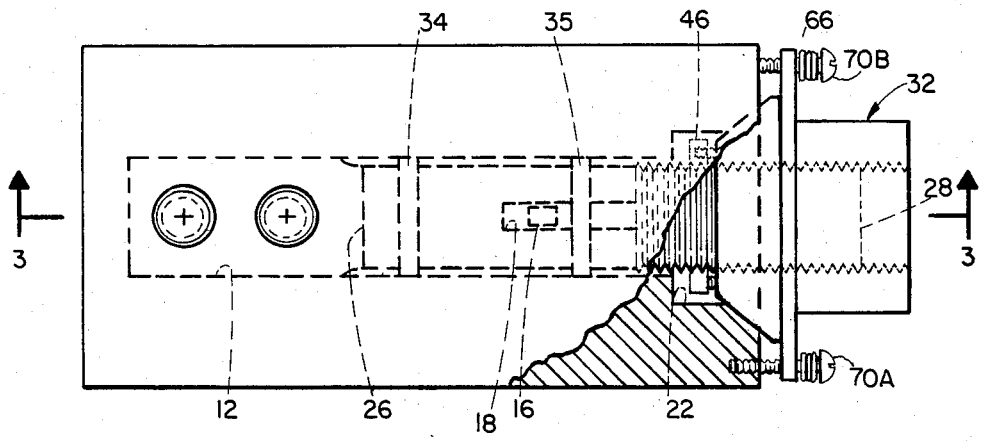
FIG. 1 is a top-plan view of apparatus embodying this invention.
Figure 2:
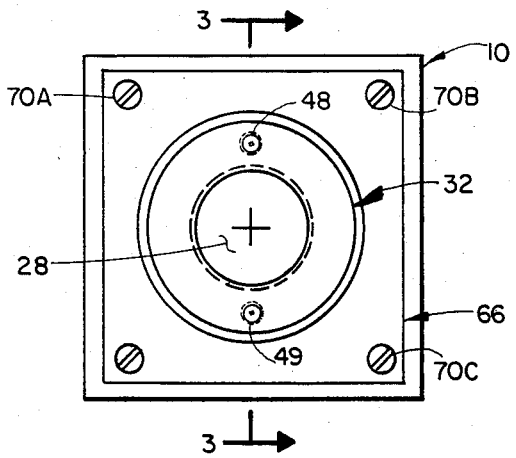
FIG. 2 is a side elevation view of the apparatus in FIG. 1.

The tuning mechanism for providing axial movement of the plunger in the bore 12 comprises a brass ring 46 having a threaded center hole therethrough, the knob 32, and a pair of set screws 48 and 49. The knob has a pair of threaded holes 52 and 54 extending therethrough. These holes are spaced equally distant from the center line thereof and 180 degree apart, with the axes thereof being parallel to the axis A—A of the knob and bore. The ring 46 has a pair of blind holes 53 and 55 similarly located therein and facing the knob, with the diameter of the holes 53 and 55 being greater than the major diameter of threads in the holes 52 and 54. The diameter of the ring 46 is less than that of the recess 22 in the block 10 so that it will fit into this opening. The front of the knob is shaped like a truncated cone for providing a smooth mating surface 58 having the same slope and taper as that of the surface 20 on the block. The thickness of the front of the knob is selected for spacing a shoulder 60 thereon a prescribed distance away from the one end 14 of the block when the surfaces 20 and 58 are continguous as is shown in FIG. 1 and described more fully hereinafter.

The waveguide apparatus in the figures is assembled by locating the dielectric sleeves 34 and 35 on the plunger, inserting the key 16 in the plunger, and threading the ring 46 and krob 32 onto the plunger with a small gap of approximately 0.030 inch therebetween. After the holes 52 and 54 in the knob are aligned with associated holes 53 and 55 in the ring, with an appropriate spacing therebetween, the set screws 48 and 49 are threaded into the holes 52 and 54 until they bottom out in the blind holes 53 and 55 in the ring. The plunger is then inserted into the bore 12, with the key 16 in the keyway 18, until the tapered surfaces 20 and 58 on the block and knob are engaged. An apertured pressure-retainer plate 66 is then moved over the body 68 of the knob until it contacts the shoulder 60 on the latter. The tuning knob and plunger assembly are retained in the block by locating spring loaded screws 70 in associated holes 71 in the block. The set screws 48 and 49 are then backed away from the bottoms of the blind holes so that the knob and ring may rotate together on the plunger when the tuning knob is turned. Finally, the knob and plunger are securely-rotatably mounted on the block end 14 by tightening the screws 70 until the plate 66 forces the tapered face 58 of the knob firmly against the mating surface 20 of the block, while still allowing the knob and ring to turn relatively freely.

Prior to tuning the cavity, the set screws 48 and 49 are alternately loosened and retightened until they press lightly against the bottoms of the blind holes in the ring with sufficient force to push the knob and ring far enough apart to substantially eliminate all backlash or clearances in the threads of these elements, while maintaining freedom of rotation of the knob and ring. Rotation of the knob, and thus the ring 46, now provides smooth, even and continuous axial movement of the plunger in the bore 12. This structure has been found to substantially eliminate sudden movements of the plunger and jumps in the frequency characteristics of the cavity, even when the direction of travel of the plunger is reversed. Upon completion of tuning the cavity, the set screws 48 and 49 are tightened firmly against the bottoms of the blind holes for binding the threads on the ring, knob and plunger so as to prevent further rotation of the knob and axial movement of the plunger. The final position of the plunger in the tuned cavity has been found to be extremely stable in that slight bumps and vibration from carrying the unit around have not detuned the device.

Although this invention is described in relation to preferred embodiments thereof, variations and modifications will occur to those skilled in the art. By way of example, the support rings 34 and 35 may be located in recesses (not shown) that are cut in the circumference of the plunger. Alternately, they may be metal rings or formed as an integral part of the plunger during a machining process. Additionally, the tuning mechanism may be associated with a coaxial cavity or other type of device supporting electromagnetic waves, or with structure that does not support electromagnetic waves. Further, the tuning mechanism may be associated with any threaded elements that are used for moving a member. Also, the key 16 may be made of either a dielectric or conductive material. Additionally, the plunger may be longer than that illustrated in FIGS. 1 and 3 and the retaining ring 46 located on the other side of the knob. The threaded holes 52 and 54 are then located in the retaining ring, with the blind holes being located in the knob. Further, a plurality of greater than 2 set screws and associated holes may be located in the ring and knob for reducing backlash and locking the assembly, with the screws symmetrically located around the center line A—A in FIG. 3 or located in some other pattern. And the tuning probe may be a screw or similar element. The scope of this invention is therefore to be defined from the appended claims rather than from the aforementioned detailed descriptions of preferred embodiments thereof.

What is claimed is:

1. Apparatus comprising:

an enclosure supporting electro-magnetic waves and having an opening in one wall thereof;

a tuning probe having its circumference threaded over at least a portion of the length thereof, said probe extending through said opening in said wall and into the interior of said enclosure;

a lock ring having a threaded bore extending therethrough, being threaded onto said probe, and having at least a pair of holes therein with axes at least generally parallel to the axis of the bore therein;

a tuning knob having a threaded bore extending therethrough, and being threaded onto said probe so as to establish a predetermined spacing between said knob and ring; said knob also having at least a pair of holes therein with axes that are generally parallel to the axis of the bore therein and located in the same orientation as associated holes in said ring so that they may be axially aligned; said holes extending all the way through one of and only part way through the other of said knob and ring; the holes in the one and other of said knob and ring also being threaded and having a diameter that is greater than that of the threaded holes, respectively;

screw means threaded through each of the holes in said one of and extending into the associated blind hole of said other of said knob and ring;

means for securely-rotatably mounting said knob on said enclosure wall for preventing axial movement of said knob; and means for preventing rotation of said probe in said enclosure;

rotation of said knob and ring providing axial movement of said probe in said enclosure to a desired position; threading said screw means into the blind holes in the other of said knob and ring for causing the ends of said screw means to firmly contact the bottoms of the blind holes binding the threads on said probe, knob and ring for preventing further rotation of the knob and further axial movement of said probe.

2. Apparatus according to claim 1 wherein ends of said screw means are either lightly touching or backed away from the bottoms of the blind holes in the other of said knob and ring for allowing for rotation thereof.

3. Apparatus according to claim 2 wherein the portion of said wall adjacent to said opening therein and the exterior of said tuning krob have mating surfaces for enabling rotation of said knob.

4. Apparatus according to claim 3 wherein said mating surfaces are tapered.

5. Apparatus according to claim 4 wherein said knob has a shoulder in a plane that is generally orthogonal to the longitudinal axis and said securing means comprises a spring loaded means contacting said shoulder for forcably engaging said mating surfaces in said wall and knob.

6. Apparatus according to claim 3 wherein the holes in said knob are threaded, said one wall having a recess therein for receiving said ring.

7. Apparatus according to claim 3 wherein the holes in said ring are threaded, said knob being located on said probe between said ring and said one wall.

8. Apparatus for precisely locating the axial position of a first member that is threaded into an opening in knob means, the latter being securely-rotatably mounted on a support member, so as to prevent movement of the knob means along the axis of the opening therein, and of selectively locking the knob means and first member so as to prevent further rotation of the knob means and axial movement of the first member, comprising:

a second member that is threaded onto the first member on one side of the knob means and spaced a prescribed distance therefrom, said second member and knob means having at least a pair of holes extending completely through one of and only part way through the other of the knob means and second member when associated holes therein are aligned, the holes in the one and other of said knob means and second member being threaded and having a diameter that is greater than the major diameter of the threaded holes, respectively;

means for preventing rotation of said first member so that rotation of the knob means causes movement of the first member in the knob means and along the axis thereof; and screw means threaded in each of the holes in said one of and into the blind holes in the other of the knob means and second member, with the ends of the screw means either lightly touching or backed away from the bottoms of the blind holes;

rotation of the knob means, and thus said second member, providing axial movement of the first member to a desired position; tightening the screw means into the holes for causing the ends thereof to firmly contact the bottoms of the blind holes in the other of the knob means and second member binding the threads on the first and second members and in the knob means for preventing further rotation of the knob means and axial movement of the first member.

9. The method of precisely locating the axial position of a first member that is threaded into an opening in a knob, the latter being securely-rotatably mounted on a support member so as to prevent axial movement thereof, and of selectively locking the knob and first member so as to prevent further rotation of the knob and axial movement of the first member, comprising the steps of:

forming threads in an opening through a second member for enabling threading it onto the first member on one side of the knob;

forming at least a pair of holes in the knob and second member which may be axially aligned and are generally parallel to the axis when they are threaded on the first member, with the holes extending completely through one of and only part way through the other of said knob and second member, the holes in the one and other of the knob and second member being threaded and having a diameter that is greater than the major diameter of the threaded holes, respectively;

threading the knob and second member onto the first member, with the holes in the one facing the holes in the other;

spacing the knob and second member a predetermined distance apart on the first member with associated holes therein being aligned;

securely-rotatably mounting the knob on the support member for preventing axial movement of the former;

preventing rotation of the first member so that rotation of the knob causes axial movement of the first member within the knob and along the axis;

threading screw means in each opening in the one of and into the hole in the other of the knob and second member, with the ends of the screws means backed away from the bottoms of the blind holes in the other of the knob and second member;

rotating the knob, and thus the second member, for providing axial movement of the first member to a desired position; and tightening the screw means into the holes for causing ends thereof to firmly contact the bottoms of the blind holes in the other of the knob and second member for binding the threads on the first member, knob and second member, for preventing further rotation of the knob and movement of the first member.

10. The method according to claim 9 wherein said step of threading screw means in openings in the one of the knob and second member further comprises adjusting the axial positions of the ends of the screw means in associated holes so that they press lightly on the bottoms of the blind holes in the other of the knob and second member for substantially eliminating any backlash in the threads on the first and second members and the knob while still providing for rotation of the knob on the first member.

11. The method of precisely locating the axial position of a tuning probe in a cavity, the probe being threaded into an opening in a tuning knob that is securely-rotatably mounted on a wall of the cavity so as to prevent axial movement thereof, and of selectively locking the knob and first member so as to prevent further rotation of the knob and axial movement of the probe, comprising the steps of:

forming threads in the central opening in a locking ring for enabling threading it onto the tuning probe on one side of the knob;

forming at least a pair of holes in both the knob and the ring, associated holes being axially aligned and having axes which are generally parallel to the axis when they are threaded on the tuning probe, with the holes extending completely through one of and only part way through the other of said knob and ring, the holes in the one and other of the knob and ring being threaded and having a diameter that is greater than the major diameter of the threaded holes, respectively;

threading the knob and ring onto the tuning probe, with the holes in the one facing the holes in the other thereof;

spacing the knob and ring a predetermined distance apart on the probe with associated holes therein being aligned;

securely-rotatably mounting the knob on the cavity wall for preventing axial movement of the former;

preventing rotation of the probe so that rotation of the knob causes axial movement of the probe within the knob and along the axis thereof;

threading screw means in each threaded hole in the one of and into the hole in the other of the knob and ring, with the ends of the screws means backed away from the bottoms of the blind holes in the other of the knob and ring;

rotating the knob, and thus the ring, for providing axial movement of the tuning probe to a desired position; and tightening the screw means into the blind holes for causing the ends thereof to firmly contact the bottoms thereof in the other of the knob and ring for binding the threads on the probe, knob and ring for preventing further rotation of the knob and movement of the probe.

12. The method according to claim 11 wherein said step of threading screw means in holes in the one of the knob and ring further comprises adjusting the axial positions of the ends of the screw means in associated holes so that they press lightly on the bottoms of the blind holes in the other of the knob and ring for substantially eliminating any looseness in the threads on the probe and ring and knob while still providing for rotation of the knob on the probe prior to moving the probe to the desired axial position in the cavity.

* * * * *